US011524800B2

(12) United States Patent
Stuhlmann

(10) Patent No.: US 11,524,800 B2
(45) Date of Patent: Dec. 13, 2022

(54) DEVICE AND METHOD FOR WRAPPING CONTAINER GROUPS

(71) Applicant: KHS GmbH, Dortmund (DE)

(72) Inventor: Christopher Stuhlmann, Korbach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/292,643

(22) PCT Filed: Nov. 5, 2019

(86) PCT No.: PCT/EP2019/080294
§ 371 (c)(1),
(2) Date: May 10, 2021

(87) PCT Pub. No.: WO2020/099194
PCT Pub. Date: May 22, 2020

(65) Prior Publication Data

US 2022/0009658 A1 Jan. 13, 2022

(30) Foreign Application Priority Data

Nov. 13, 2018 (DE) ..... 10 2018 128 351.2

(51) Int. Cl.

| | |
|---|---|
| ***B65B 11/00*** | (2006.01) |
| ***B65B 5/06*** | (2006.01) |
| ***B65B 41/02*** | (2006.01) |
| ***B65B 51/02*** | (2006.01) |
| ***B65B 5/02*** | (2006.01) |

(Continued)

(52) U.S. Cl.
CPC ..... *B65B 11/004* (2013.01); *B65B 5/024* (2013.01); *B65B 5/06* (2013.01); *B65B 11/10* (2013.01); *B65B 21/245* (2013.01); *B65B 35/44* (2013.01); *B65B 41/02* (2013.01); *B65B 49/10* (2013.01); *B65B 51/023* (2013.01); *B65B 41/12* (2013.01); *B65B 53/00* (2013.01)

(58) Field of Classification Search
CPC ..... B65B 11/10; B65B 11/004; B65B 49/10; B65B 51/023; B65B 21/24; B65B 21/245; B65B 5/024; B65B 5/06; B65B 27/04; B31B 50/624; B31B 70/628
See application file for complete search history.

(56) References Cited

U.S. PATENT DOCUMENTS 3,196,588 A * 7/1965 Chidsey, Jr. ..... B65B 11/105 53/48.9
3,364,055 A * 1/1968 Nelson ..... B31B 50/00 118/302

(Continued)

FOREIGN PATENT DOCUMENTS

AU 3704595 A 5/1996
CN 102099260 A 6/2011

(Continued)

*Primary Examiner* — Joshua G Kotis
(74) *Attorney, Agent, or Firm* — Occhiuti & Rohlicek LLP

(57) ABSTRACT

A machine that forms groups of containers by wrapping containers in a film blank includes an adhesive applicator that is arranged along a film-transporter for applying adhesive onto an inner side of the film blank and along longitudinal side edges of the film blank before the containers are wrapped. The placement of the adhesive avoids distortion of images or text that are printed on the film blank due to shrinkage.

6 Claims, 6 Drawing Sheets

(51) Int. Cl.

| | |
|---|---|
| ***B65B 11/10*** | (2006.01) |
| ***B65B 35/44*** | (2006.01) |
| ***B65B 49/10*** | (2006.01) |
| ***B65B 21/24*** | (2006.01) |
| *B65B 41/12* | (2006.01) |
| *B65B 53/00* | (2006.01) |

(56) References Cited

U.S. PATENT DOCUMENTS

| | | | | |
|---|---|---|---|---|
| 3,629,991 | A | 12/1971 | Sundin | |
| 4,878,337 | A * | 11/1989 | Raudat | B65B 61/207 53/543 |
| 6,128,888 | A * | 10/2000 | Gambetti | B65B 11/10 53/589 |
| 6,223,499 | B1 | 5/2001 | Wilkey | |
| 2003/0049371 | A1* | 3/2003 | Fort | B65B 51/023 427/207.1 |
| 2005/0072123 | A1* | 4/2005 | Gambetti | B65B 11/10 53/210 |
| 2005/0193880 | A1* | 9/2005 | Chao | B65B 57/12 83/349 |
| 2010/0064637 | A1* | 3/2010 | Kollmuss | B65B 41/16 53/461 |
| 2015/0307249 | A1* | 10/2015 | Stuhlmann | B65B 53/00 53/413 |
| 2016/0288935 | A1* | 10/2016 | Gatteschi | B65B 53/02 |
| 2019/0112085 | A1* | 4/2019 | Kirzinger | B65B 21/06 |

FOREIGN PATENT DOCUMENTS

| | | | | |
|---|---|---|---|---|
| CN | 102653321 | A | 9/2012 | |
| CN | 103395556 | A | 11/2013 | |
| CN | 105984601 | A | 10/2016 | |
| CN | 107848653 | A | 3/2018 | |
| DE | 69208175 | T2 | 9/1996 | |
| DE | 19512547 | A1 | 10/1996 | |
| DE | 69719447 | T2 | 12/2003 | |
| DE | 102017203660 | A1 * | 9/2018 | |
| DE | 102018116129 | A1 * | 1/2020 | |
| WO | WO-2013045806 | A1 * | 4/2013 | B05B 12/122 |

* cited by examiner

DEVICE AND METHOD FOR WRAPPING CONTAINER GROUPS

RELATED APPLICATIONS

This is the national stage under 35 USC 371 of international application PCT/EP2019/080294, filed on Nov. 15, 2019, which claims the benefit of the Nov. 13, 2018 priority date of German application DE102018128351.2, the contents of which are herein incorporated by reference.

FIELD OF INVENTION

The invention relates to packaging, and in particular, to wrapping a group of containers with a web material.

BACKGROUND

It is known to wrap a group of containers with shrink wrap. The wrapped group is then passed through a heated tunnel, which causes the shrink wrap to shrink. This results in a container group in which the shrink wrap secures the containers to each other.

During the wrapping process, lateral film projections are additionally applied to the face sides of the container. This can lead to a fold formation occurring in the region of the face sides. Many consumers infer that such packaging defects also imply a deficient product.

The shrinkage process also results in the film cuts on the front side and rear side of the group at which distortions and folds can occur. In those cases in which the film has material printed on it, these distortions often make the printed motif illegible.

SUMMARY

The invention is therefore based on the object of providing a method and device that allow for an improvement in the packaging appearance, in particular in the case of a maximally closed shrinking eye or a folding packaging, to enable a distortion-free motif on a packaging group and minimization of fold formation in the region of the face sides of the packaging group.

According to the invention, the device for producing a packaging group wrapped with a web material comprises at least one packaging group transport device, which transports the packaging group through a folding and/or wrapping device, wherein the folding and/or wrapping device comprises a wrapping element that is guided above and beneath the at least one packaging transport device, for receiving the web material and for wrapping the packaging with the web blank, and, for transporting the web material and the web blank, a material transport device is provided with a first transport segment, which extends from a dispensing device for the web material as far as a specified contact region of the folding and/or wrapping element with a web blank, and with a following second transport segment, which follows on from the first transport segment and extends as far as the end of the packaging group transport device, and a cutting station configured for the cutting of a web material for the forming of the web blank, with a transport device arranged upstream of this for the transport and guiding of web blanks onto the transport plane formed on and above the packaging group transport device, wherein arranged in the region of the transport segment is an adhesive application device, which is configured such as to apply adhesive onto the inner side of the web blank and in the region of the longitudinal side edges of the film blank. As an alternative, in particular in the case of web blanks made of a paper and/or card material, the web blanks are also provided stacked and already cut on a presentation unit, from where they are conveyed individually by means of a detection and transfer unit onto the transport device.

The core of the device is an adhesive application device, that can be easily integrated into an already existing folding and/or wrapping device. Surprisingly, this is provided by means of an adhesive application device that applies the adhesive onto the web material or the web blank and not onto the container. As a result, an arrangement of the adhesive application device is possible that makes particularly effective use of the structural space of a folding and/or wrapping device.

The adhesive is applied by the adhesive application device in such a way that the web blank is adhesively bonded to the face sides of the wrapped packaging group with the containers of the group, in particular of the corner containers. As a result, fixing takes place of the web blank before the shrinking process, which at least very substantially prevents distortion of the web blank, and therefore also prevents a distortion of a motif printed on the web blank. Due to the fact that, during the shrinking process, the bonded web blank is drawn perceptibly less in the direction of the front side and rear side of the packaging group, a particularly small shrinkage hole is also produced, with low film consumption and a perceptibly smaller fold formation with the web blank. The film of the web blank is configured as shrink film. After the wrapping, the packaging group is conveyed from the packaging group transport device onto a discharge transport device and transported to a device for shrinking the web blank.

The discharge transport device, the packaging group transport device, and also a transport device conveying the packaging group onto the packaging group transport device, are configured, for example, as conventional transport bands or belts from the beverage industry sector, while conversely the film transport device can comprise, for example, vacuum tables.

Containers in the meaning of the invention are, for example, bottles, cans, tubes, in each case made of metal, glass, and/or plastic, in particular PET bottles, but also other packaging materials, in particular such as are suitable for the filling of fluid or viscous products. In particular, beverage containers can be understood to be containers. A packaging group is formed by a group of assembled containers. The containers of the packaging group are arranged in a nesting or non-nesting position. The expression "packaging group" can also be understood in connection with the invention, as well as a container group in which the containers are already connected among one another, to be a container group of which the containers are assembled but not yet connected to one another, and that it is intended should only be connected to one another by the film wrapping.

The folding and/or wrapping device comprises, in the case of a film wrapping, a wrapping element that receives the film blank coming from the first transport segment, slides along on the outer side of the film blank, and overtakes the packaging group being transported on the packaging group transport device, as a result of which the film blank is brought into contact with its inner side onto the containers. Before the reception of the film blank by the wrapping element, the film blank, coming from the transport device, is placed with a front edge on the packaging group transport device, and the packaging group is placed onto the inner side of the film blank in the region of the front edge.

In order to wrap the film blank around the packaging group, after the setting of the container group onto the front edge, the wrapping element rises up from beneath the wrapping group transport device, comes in contact at the outer side of the film blank, guides the film blank around the packaging group, and at the end of the packaging group transport device again lowers down beneath the packaging group transport device. At the end of the wrapping, the packaging group can be set upright onto the rear edge of the film blank, opposite the front edge of the film blank. After the wrapping, further transport takes place to a shrinking device, for example a shrinking tunnel.

The packaging group is then transported on the transport device, with its front side leading, while the wrapping of the packaging group takes place around the packaging group starting from the rear side. The wrapping element can be formed, for example, as a rotating bar element.

Cutting stations are likewise known. On these, for example, a shrink film present in the form of roll material is unrolled and cut into film blanks. The film blanks of the film are transported on the transport device, which, as already described, can comprise, for example, a vacuum table, to the transport plane of the packaging group transport device. There a front edge of the film blank is received by the wrapping element.

During transport on the film transport device, the front edge is the edge arranged in front in the conveying direction, while the rear edge is the edge of the film blank opposite the front edge. Front edge and rear edge are arranged transversely in the conveying direction. The longitudinal side edges are the lateral longitudinal edges aligned in the conveying direction, i.e. the side edges extending from the front edge to the rear edge. In connection with the invention, the longitudinal side edges are understood in particular to be a region of the film blank that extends from the actual outer edge of the film (of the film blank) by, for example, several centimeters inwards towards the opposite side edge, and, in the wrapped state, are in contact with the face side of the packaging group. The face side of the packaging group is understood to be the lateral face of the packaging group, at which the shrinkage hole is formed. The adhesive bonding of the film blank to the containers of the packaging group takes place in the region of the face sides of the packaging group, i.e. in the region of the open longitudinal side edges of the wrapped film blank. The bonding takes place in particular with the corner containers of the packaging group. Wrapped film longitudinal side edges preferably neither abut one another nor overlap, such that the packaging group on the face side is free of film at least in some regions, and the shrinkage hole is formed.

In the event of the web material being a paper or card blank, the foregoing process applies by analogy, but no shrink tunnel is required.

It may additionally not be necessary for wrapping to take place, in that the packaging group is transported with its front side leading on the packaging group transport device, while the wrapping of the packaging group takes place around the packaging group starting from the rear side, by means of a circulating bar element. In this case, other folding tools and folding processes known from the prior art are used for paper blanks and/or card blanks.

It may however be advantageous for the folding and wrapping device to comprise suitable tautening and/or tensioning elements, in order for a paper blank or card blank, placed over a container group, around a container group, or at a container group to be tautened or tensioned at least in one spatial direction, ideally in two spatial directions, once or several times.

Adhesive or gluing means in the meaning of the invention can be all materials or compounds with which an adhesive connection can be produced between the film and the containers of the packaging group or between two sections of the film. In particular, the adhesive or gluing means are formed from the group of hot or melt adhesives. For convenience, the term "hot-melt adhesive" encompasses hot adhesives, melt adhesives, and hot-melt adhesives.

The conveying direction is the transport direction of the web material or the web blank, starting from the dispensing unit as far as the packaging group completely wrapped in a web blank.

The transport plane can be understood to be the plane formed by the packaging group transport device, in which the packaging group is transported by the packaging group transport device. In this situation, the packaging groups can stand upright during the transport on the packaging group transport device, for example a packaging group transport table, a conveyor belt, or the like.

The contact region is the region along the conveying path in which the folding and/or wrapping element comes in contact with the web blank.

According to a further embodiment of the invention, the first transport segment comprises a part segment section that extends in the conveying direction from the cutting station to the end of the transport segment, wherein, in the region of the part segment section, in particular underneath the transport plane of the packaging group, the adhesive agent application device is arranged.

The first part segment section therefore also comprises the first transport device for delivering the film blanks onto the transport plane formed on and above the packaging group transport device.

The adhesive agent application device is for particular preference arranged in the region of the first transport device. This can in particular be a part of the first part segment section, and therefore arranged in a vertical direction underneath the transport plane of the packaging groups. As a result of this, the application of the adhesive can take place particularly easily onto the inner side and onto the longitudinal side edges of the web blank. In this connection it is noted that, depending on the transport path length of the first part section, the adhesive application can, if appropriate, also take place onto the inner side of the (not yet cut) web material (film, paper, card, etc.), if, for example, in a first section the web material is already unrolled from a dispensing roll, but the separation cut has not yet taken place to produce the web blank. To this extent, hereinafter the application of the adhesive agent onto the web section blank can, if appropriate, be understood to be an application onto the web material that has not yet been cut but is cut shortly after this.

The application of the adhesive agent onto the web blank takes place in the region of the material transport device. In this situation, according to a further embodiment of the invention, provision is made for the device for applying the adhesive agent is formed in the end region of the first transport device and before the delivery of the web blank onto the packaging group transport device. In this situation, the end region of the first transport device is understood in particular to be the last third of the first transport device, for example of a vacuum table, or the transitional region between the end of the first transport device and of the packaging group transport device. This therefore guarantees that the adhesive agent is applied shortly before the wrapping of the packaging group onto the web material or the web blank, as a result of which, for example, incorrect adhesive applications are avoided.

Ideally, the adhesive agent application device is suitable for the application of adhesive agents that belong to the group of hot or melt adhesives. The application takes place free of contact by means of application nozzles or spray nozzles. In this situation, as a rule, an application nozzle or a spray head is provided per application location, such that, in running operation of the system, these do not have to be moved or pivoted. An application nozzle or a spray head can apply an adhesive agent onto the conveyed web material or onto a web blank, at points in a row or in lines.

The application nozzles or spray heads are connected to known associated storage containers, heating devices, etc., and are fed by these.

According to a further embodiment of the invention, at least one adhesive agent head or adhesive agent application device is capable of being moved transversely to the conveying direction of the web blank. The adhesive agent head can therefore be moved between the longitudinal side edges of the web blank, such that, by means of an adhesive agent head, adhesive agent can be applied onto both longitudinal side edge regions. It is also possible, by means of the movable adhesive agent head, for adhesive agent to be applied onto regions of the web blank between the longitudinal side edges, such that, for example, an additional adhesive bonding of the web blanks to one another or of the web blanks to the containers of the packaging group can be achieved.

In order, for example, to increase the throughput speeds of the device, the adhesive agent application device comprises for particular preference at least two adhesive agent heads, which are arranged on opposing sides of the first transport device. As a result of this, the adhesive agent can be applied onto both longitudinal side edges of the web blank, without the need for a time-consuming movement of the adhesive agent head. The time expenditure for the to-and-fro movement of the adhesive agent heads can be avoided.

As a supplement, however, it is also possible for both adhesive agent heads to be mounted so as to be movable transverse to the transport device, as a result of which it is also possible for adhesive agent to be applied particularly rapidly onto regions of the web blank lying outside the longitudinal side edges. It is of course also possible for further adhesive agent heads to be arranged, for example a third or fourth adhesive agent head.

In order to be able to make optimum use of the structural space of the device, the cutting station can be arranged in the vertical direction underneath the transport plane of the packaging group (packaging group transport device, supply transport device), such that the web blank for wrapping the packaging group is guided coming from below onto the packaging group transport device. In order to make optimum use of the structural space of the device, and in particular so as not to obstruct the transport path of the packaging groups on the respective transport device, provision can be made, as already described, for the adhesive agent application device to be arranged in a vertical direction beneath the packaging group transport device.

Just as with the cutting station, the adhesive agent application device can also be arranged in a horizontal direction offset to the packaging group transport device and, for example, directly beneath a delivery transport device that transfers the packaging group onto the packaging group transport device.

In order to ensure a particularly exact positioning of the longitudinal side edges of the web blank provided with the adhesive agent on the face sides of the packaging group, according to a further embodiment of the invention provision is made for a pressing element (stroking element) to be arranged, which moves a projection of material with the longitudinal side edges, after the wrapping, to the face sides of the packaging group. In, this situation, the pressing element exerts a pressure against the material projections present in the face side region, and therefore also against the longitudinal side edges of the web blank provided with the adhesive agent, as a result of which the material projections are moved around the corner containers of the packaging group and the upwards projecting material projections of the web blank are pressed onto the face side of the packaging group. As a result of the adhesive agent on the longitudinal side edges coming in contact with the containers of the packaging group, in particular the corner containers, the web blank, and for example the film blank, adheres to the containers. The pressing element can also be configured as a stroking element. As pressing or stroking element, provision can be made in particular, for example, of rollers or brushes, past which the packaging group is conveyed. The passing movement can be understood, as well as a passive passing of the packaging group, also as an active passing at the pressing element, or of the pressing element onto the packaging group. It is of course also possible for several pressing elements to be arranged or pressing elements on both sides of the packaging group.

The object is further solved by a method for producing a packaging group wrapped with a web blank with the steps: Transport of the web blank on a first transport device of a film transport device from a cutting station onto a transport plane formed on and above the packaging group transport device, wrapping of a packaging group transported on the packaging group transport device, wherein the web blank is detected by a wrapping element and, during the transport, is moved around the packaging group, wherein, during the transport of the web blank, in the region of the first transport device, an adhesive agent is applied onto the web blank in the region of the inner surface and in the region of the longitudinal side edges of the web blank, and the longitudinal side edges of the web blank are adhesively bonded to the face sides of the packaging group after the wrapping.

The application of the adhesive agent onto the web blank instead of onto the containers allows for a particularly space-saving arrangement of an adhesive agent application device. In this situation, the adhesive agent application device can in particular be integrated into the existing structural space of the folding and/or wrapping device. By means of the adhesive bonding, in addition, a fixing effect is attained of the open ends of the web blank to the face surfaces of the packaging group before the shrinking process, as a result of which a distortion of the web blank on the front side and rear side due to shrinkage is avoided. Specifically, with the web blanks printed with a motif, which are used for particular preference, a distortion of the motif can thereby be prevented. In addition to this, the adhesive bonding has the effect of forming a shrinkage hole that is closed as far as possible with a smallest possible quantity of film, by means of which a fold formation is very largely avoided.

In order for the film projection with the wrapped packaging group to be laid particularly precisely in contact on the face sides of the packaging group and adhesively bonded, provision is made according to a further embodiment of the invention that a pressing element moves a film projection, with the wrapped packaging group, with the longitudinal side edges, to the face sides of the packaging group. As a result of this, the film projection is laid around the corner containers of the packaging group in contact with the face sides of the packaging group, and the adhesive agent applied to the longitudinal side edges is bonded to the containers, in particular to the corner containers of the packaging group.

As already described, the web blank used is for particular preference printed, for example with a motif of a manufacturer. Due to the improvement of the shrinkage appearance due to the adhesive bonding of the web blank before the shrinking, the packaging groups can for particular preference be produced as groups free of banner strips, i.e. there is no longer any need for banner strips with a corresponding motif to be arranged underneath the film, since this is now printed onto the web blank.

In order to keep the extent of the adhesive agent application as low as possible, and to avoid erroneous adhesive applications due to excessively large adhesive sections, provision is made according to a further embodiment of the invention that the adhesive agent is applied as points of adhesive agent, the adhesive bonding of the web blank to the containers is effected only in the form of points, and not, for example, in the form of strips of adhesive agent or large-surface adhesive bonds. As a result of this, a particularly good control of the shrinkage behavior of the web blank can be applied during the shrinkage process.

For particular preference, on each longitudinal side edge of the web blank at least one individual adhesive agent point is applied per front side and rear side of the packaging group. Specifically with transparent web blanks, which are not printed or exhibit only a small motif print, one adhesive agent point on each longitudinal side edge per front side and rear side is sufficient in order to prevent any significant interfering distortion of the web blank in the region of the front and rear side of the packaging group.

According to a further embodiment of the invention, however, provision is made that on each longitudinal side edge of the web blank at least two adhesive agent points are applied per front side and rear side, spaced at a distance interval from one another, i.e. the adhesive agent points are applied at a distance interval from one another in the direction of the longitudinal side edges. The distance interval between two adhesive agent points on a longitudinal side edge can correspond, for example, at least to the height (in the vertical direction) of the motif imprint, as a result of which a particularly good pre-fixation of the printed surface section of the web blank is achieved.

In addition, for the adhesive bonding of the web blank to the face sides of the packaging group, further sections of the web blank can be provided with an adhesive agent. Accordingly, in a further embodiment of the invention provision is made for an adhesive agent application to be effected in the region of the front edge of the web blank and/or the rear edge of the web blank, in order to bond the web blank to the container bases of the containers belonging to the packaging group or in order to bond the front edge and rear edge of the web blank to one another. Here too, the adhesive agent is preferably applied as adhesive agent points.

It is further to be noted that, as well as particularly good control of the shrinking process, by the application of the adhesive agent it can also be ensured that the consumer can open the film packaging easily.

According to a further embodiment of the invention, an adhesive agent is used that can be sprayed and/or can flow, in particular an adhesive agent from the group of hot or melt adhesives. In addition to bonding the web blank, this further simplifies in particular the opening of the packaging group, i.e. the releasing of the web blank from the containers by the consumer.

For the particularly easy and straightforward performance of the method according to the invention, for particular preference a device is used as described heretofore.

Although several aspects have been described in connection with a device, it is understood that these aspects also represent a description of the corresponding method, such that a structural element of the device is also to be understood as a corresponding method step or as a feature of a method step. By analogy with this, aspects that have been described in connection with a method step or as a method step also represent a description of a corresponding structural element or feature of a corresponding device.

BRIEF DESCRIPTION OF THE FIGURES

The invention is described in greater detail hereinafter on the basis of exemplary embodiments. The Figures show.

DETAILED DESCRIPTION

Figure 1:
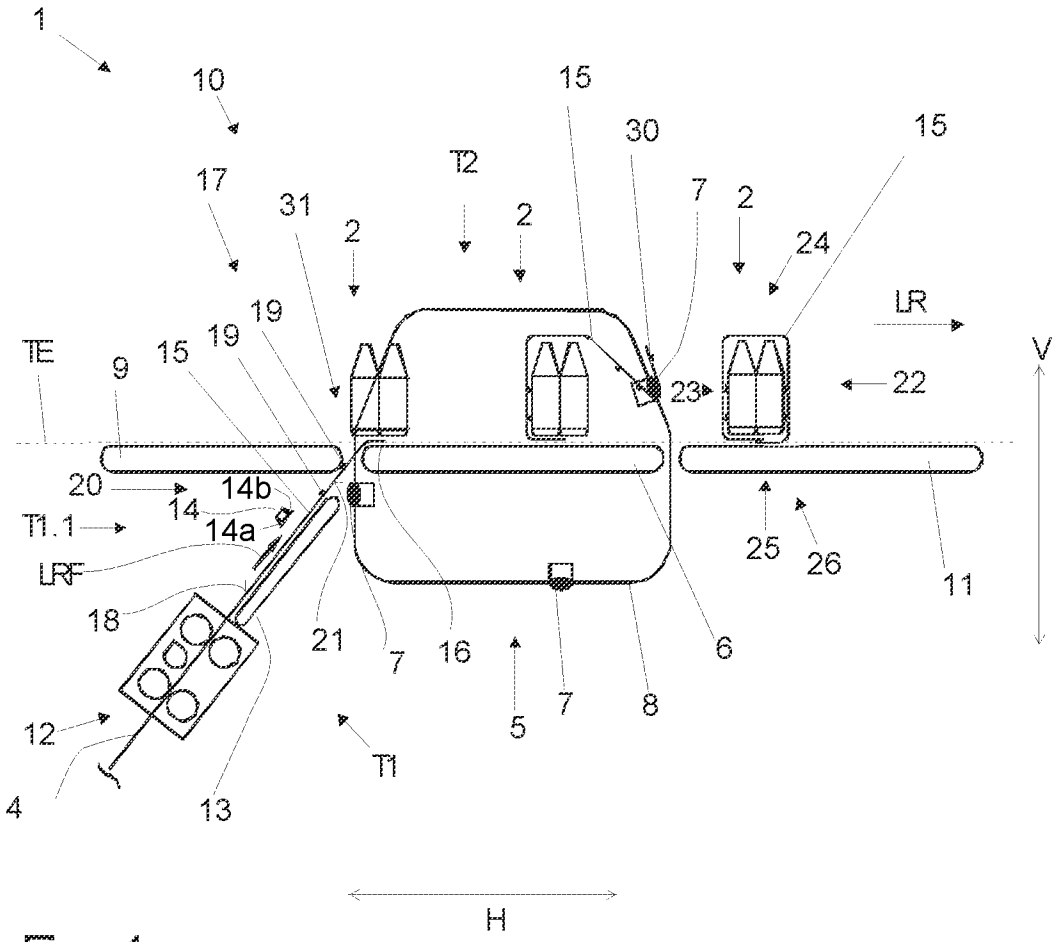
FIG. 1 shows a device for wrapping containers to form a group.

FIG. 1 shows a packaging machine 1 for wrapping a group 2 of containers 3 with a film 4. Each group 2 is a container group that is formed by wrapping containers 3 with a film blank 15, shown in FIG. 2*a*, that is made from the film 4. Each group 2 has corner containers 3*a*, as seen in FIG. 3*a*.

Figure 2A:
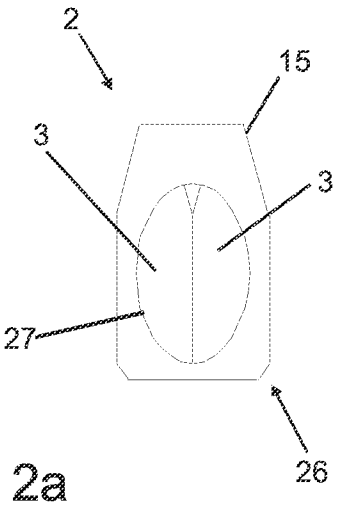
FIGS. 2*a* and 2*b* show different views of a group.
Figure 2B:
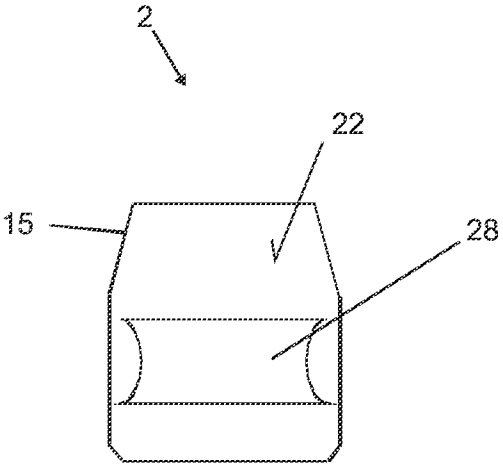
Figure 3A:
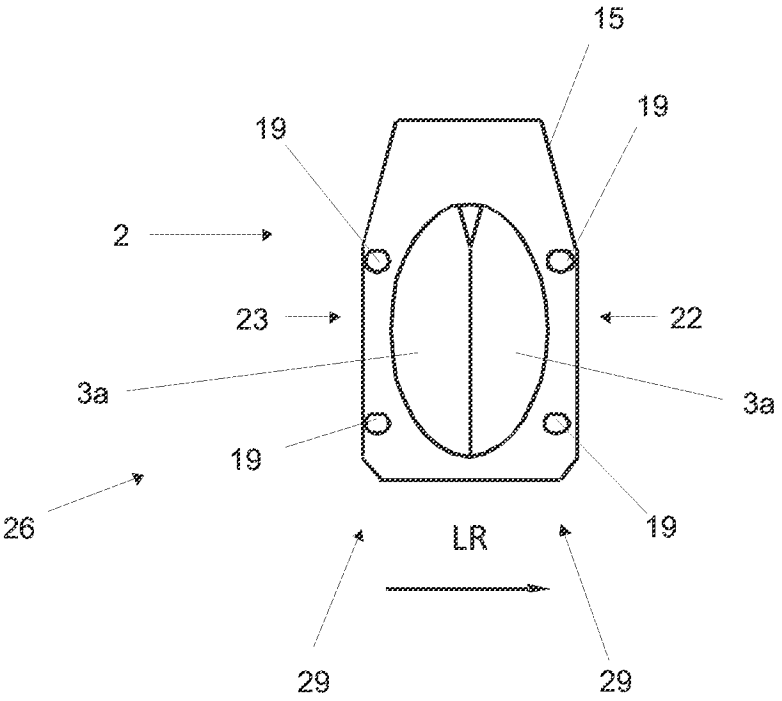
FIG. 3*a* shows a face-side view of a group.

As shown in FIG. 2*a* and FIG. 2*b*, a container group 2 has a face side 26 and a front side 22. The face side 26 has a shrinkage hole 27 formed therein. The front side 22 has a motif 28 printed thereon.

Referring back to FIG. 1, the packaging machine 1 includes a wrapper 5 and a group conveyor 6 that runs along a transport plane TE. The wrapper 5 is a folding and/or wrapping device. The group conveyor 6 is a packaging-group transport-device. The packaging machine 1 also includes at least one wrap bar 7 that moves on a track 8 around the group conveyor 6 and around whatever groups 2 are being transported on the group conveyor 6. The illustrated embodiment shows three such wrap bars 7.

The packaging machine 1 further comprises an intake transporter 9 for receiving containers 3 onto the group conveyor 6 so that they can be formed into a group 2. The packaging machine 1 also includes a discharge transporter 11 for receiving the group 2 that has been formed by wrapping the containers 3 with a film blank 15. The discharge transporter 11 transports the group 2, with a front side 22 thereof leading, along a group-transport direction LR to a shrinking device. The shrinking device has been omitted for clarity.

The packaging machine 1 also includes a first film-transporter T1 and a second film-transporter T2. As shown in FIG. 1, the first film-transporter T1, which is directly beneath the intake transporter 9, runs from a film dispenser to the transport plane TE. The second film-transport segment T2 connects to the first transport segment T1 and extends to the end of the group conveyor 6.

The film 4 that comes from the dispensing unit moves into a cutter 12 that lies below the transport plane TE. The cutter 12 separates the film 4 to form the film blanks 15.

The first film-transport segment T1 includes a post-cutter segment T1.1 that extends along a film-conveying direction LRF upwards from the cutter 12 towards the transport plane TE.

Figure 4:
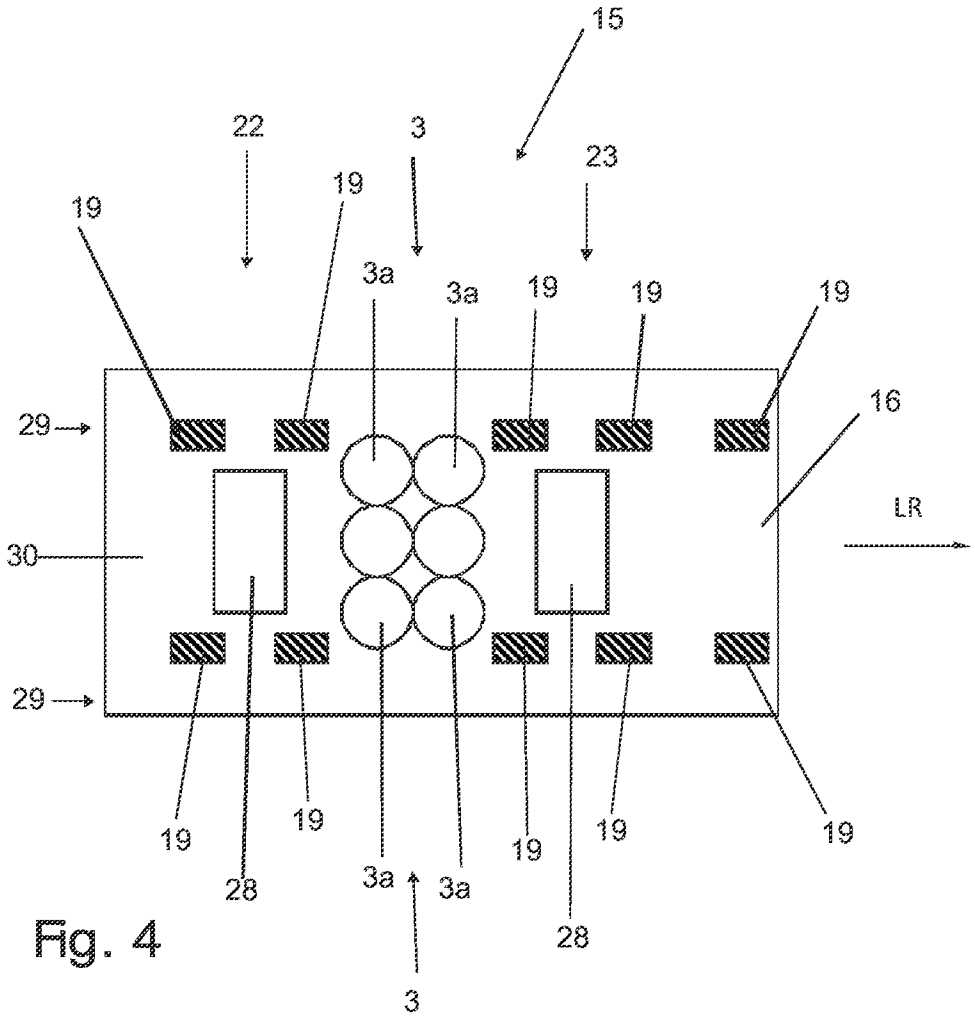
FIG. 4 shows a film blank with regions drawn for adhesive agent points and motifs.

The first transport segment T1 includes a film conveyor 13 that begins at the cutting station 12 and runs past an adhesive applicator 14, which applies adhesive 17 onto longitudinal side edges 29 of the film blank 15, as shown in FIG. 4. The film conveyor 13 then proceeds on to the transport plane TE.

The adhesive applicator 14 comprises two adhesive agent heads 14*a*, 14*b* for placing adhesive at application points 19. As shown in FIG. 3*a*, the application points 19 are spaced apart on the inner side 18 of the film web 15 along the longitudinal side edges 29. In some embodiments, application of the adhesive at the application points 19 takes place at the film conveyor's end region 20.

In some embodiments, the adhesive applicator 14 has only one adhesive head. In such cases, the head moves from one place to another to apply adhesive one point at a time. Among these embodiments are those in which the head moves transverse to the film-conveying direction LRF. In other embodiments, the head moves in a direction along the film-conveying direction LRF. In still other embodiments, the adhesive applicator 14 has more than two heads to be provided, which are likewise arranged such as to be movable or not movable as required.

In operation, the cutter 12 forms a film blank 15. The film conveyor 13, which is implemented as a vacuum table, brings the film blank 15 to the group conveyor 6. During the transport, the film blank 15 is conveyed past the adhesive applicator 14 at the end region 20. The adhesive applicator's heads apply adhesive agent onto the longitudinal side edges 29 of the film blank 15. A suitable adhesive is one that can be sprayed or one that can flow. A particularly useful adhesive agent is a hot melt adhesive agent.

Containers 3 that are to become part of a group 2 and that are delivered by the intake transporter 9 are arranged on a front edge 16 of the film blank 15. The wrap bar 7 rises from beneath the transport plane TE through a gap between the group conveyor 6 and the intake transporter 9. As it does so, it engages an outer side 21 of the film blank 15. As the wrap bar 7 climbs, it brings the outer side 21 with it.

The wrap bar 7 moves faster than the group conveyor 6. As a result, the wrap bar 7 is able to overtake the containers 3. As the wrap bar 7 descends back towards the transport plane TE, it wraps the outer side 21 of the film blank 15 around the containers 3, thus forming the group 2. Upon reaching the conveyor's end, the wrap bar 7 descends below the transport plane TE through a gap between the group conveyor 6 and the discharge transporter 11.

The group 2, which continues to move, moves onto the rear edge 30 of the film blank 15. Accordingly, the front side 22, the rear side 23, and the upper and under sides 24, 25 of the group are covered by the film blank 15. The group 2 is therefore wrapped on four sides. A lateral film projection remains over the face sides 26 with the application points 19 thereon.

A presser or stroker acts on the film projection so that it moves towards the group's face sides 26. This causes the adhesive at the application points 19 to bond to the corner containers 3*a*. The film blank 15 is then shrunken into place in a shrinking device.

FIGS. 2*a* and 2*b* show a group 2 with individual containers 3, which are wrapped or enveloped with a film blank 15. The film blank 15 is already shrunk, such that a shrinkage hole 27 is formed on the face side 26. It is apparent that the motif 28 applied on the front side 22 is distorted due to the shrinkage process of the film material.

FIG. 3*a* shows a first embodiment of a group 2 produced in accordance with the method and on the device with a film blank 15 of shrink film bonded to it as seen from the face side 26. The illustrated application points 19 bond the longitudinal side edges 29 with the group's corner containers 3*a* to the face sides 26 of the group 2. The application points 19 have been applied at a distance from one another such that two application points 19 are arranged at the respective longitudinal side edge 29 aligned with the front side and the rear side to fix the film blank 15 on the face side 26.

Figure 3B:
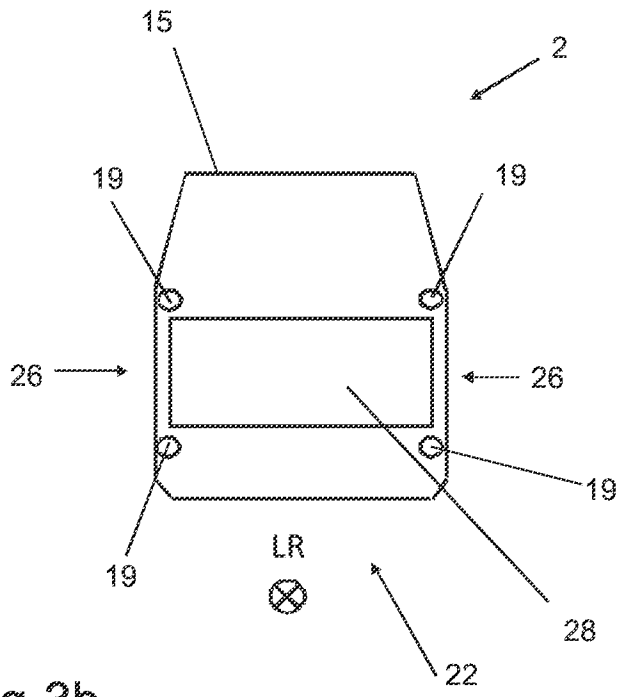
FIG. 3*b* shows a front view of the group shown in FIG. 3*a*.

FIG. 3*b* shows a front view of the group 2 shown in FIG. 3*a*. For better understanding of the effect of the application points 19, the application points 19 are likewise represented. These, however, are located on the face side 26 of the group 2. Because the film blank 15 has been bonded on the face sides 26, the motif 28 is undistorted.

Figure 3C:
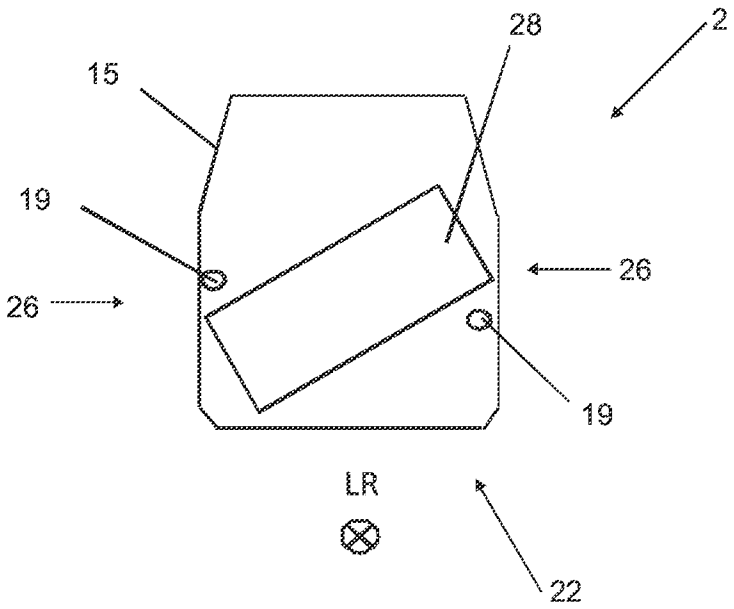
FIG. 3*c* shows an alternative embodiment of a group.

FIG. 3*c* likewise shows a front view of an alternative group 2 in which the film blank 15 is bonded at the front side 22 as well as at the rear side 23 at each longitudinal side edge 29 by only one application points 19 on the face side 26. Only to promote understanding, the application points 19 are drawn in the front view. However, they are actually present on the face side 26.

FIG. 4 shows schematically, in one view, an angled film blank 15 of a shrink film for wrapping a group 2, with regions drawn in for the application points 19, motifs 28, and the later position of the containers 3 in the film blank 15.

The film blank 15 has two motifs 28, which in the wrapped state are positioned on the front side 22 and rear side 2 of the group 2. Application points 19 are located on both of the longitudinal side edges 29. For each motif 28, in each case two application points 19 are provided per longitudinal side edge 29.

The four application points 19 around a motif are arranged at equal distances from the motif 28. This suppresses even slight distortions of the motif 28.

For the bonding of the front edge 16 of the film blank 15 to the base of the group 2 or to the base of the containers 3, two application points 19 are provided in the region of the front edge 16. As an alternative, it is also possible, for example, for application points 19 to be provided at the rear edge 30, opposite the front edge 16, in order to bond the rear edge 30 to the front edge 16.

In the figures and in the foregoing explanations, the packaging machine 1 and the method have been illustrated and described primarily for the adhesive bonding of web blanks made of film (plastic, shrink film). However, the same techniques are applicable to foldable paper and/or card materials, can also be provided for, wherein in this case, for the adhesive agent application, a device can be provided which is very largely identical in location and structure to the adhesive agent application device 14. The wrapper 5 and the elements located downstream are provided for in an analogous manner, although they are to be adapted in a manner known to the person skilled in the art for the wrapping of containers 4 with the foldable paper and/or card blanks.

As already mentioned, the adhesive applicator 14 is ideally suited for the application of hot-melt adhesive that comes out through one or more heads of the adhesive applicator 14. With one embodiment, not represented in any greater detail, at least two adhesive heads are provided and arranged on opposing sides of the film conveyor 13. Associated devices for the application of a hot or melt adhesive, such as storage containers, heating devices, pumps etc. are not shown.

The invention claimed is:

1. A method comprising:

producing a group of containers, said group having a front side and a rear side, wherein producing said group comprises transporting a film blank on a film conveyor of a first film-transporter from a cutter onto a transport plane, said film blank having front and rear motifs for placement on said front side and said rear side, respectively, during transport of said film blank and prior to said film blank having reached said transport plane, applying adhesive onto first and second longitudinal side edges of an inner side of said film blank, wherein applying said adhesive comprises, for each of said motifs, applying said adhesive at first and second pairs of application points on said first and second longitudinal side edges, respectively, wrapping said containers as said containers are being transported on a group conveyor, thereby forming said group, and after having wrapped said containers, bonding said longitudinal side edges of said film blank to face sides of said group such that said front and rear motifs are on said front and rear sides of said group, respectively, wherein said film blank is made from a film of shrink film, foldable paper, or card material.

2. The method of claim 1, wherein bonding said longitudinal side edges comprise pressing said longitudinal side edges, which project away from said group, towards said face sides.

3. The method of claim 1, wherein applying said adhesive comprises applying points of adhesive.

4. The method of claim 1, wherein applying said adhesive comprises applying at least one adhesive point to each longitudinal side edge of said film blank per front side and rear side of said group.

5. The method of claim 1, wherein applying said adhesive comprises applying at least two adhesive points on each longitudinal side edge of said film blank per front side and rear side of said group.

6. The method of claim 1, further comprising selecting said adhesive to be a hot-melt adhesive.

* * * * *